US007784754B2

(12) United States Patent
Nevers et al.

(10) Patent No.: US 7,784,754 B2
(45) Date of Patent: Aug. 31, 2010

(54) ADJUSTABLE HANGER BAR ASSEMBLY WITH BENDABLE PORTION

(75) Inventors: Craig S. Nevers, Warwick, RI (US); Robert J. Wedekind, Riverside, RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 679 days.

(21) Appl. No.: 11/296,901

(22) Filed: Dec. 8, 2005

(65) Prior Publication Data

US 2007/0131827 A1 Jun. 14, 2007

(51) Int. Cl.
*E04G 25/00* (2006.01)

(52) U.S. Cl. ..... 248/200.1; 248/906

(58) Field of Classification Search ..... 248/343, 248/317, 547, 546, 906, 200.1, 909; 362/365, 362/147, 366, 364, 363
See application file for complete search history.

(56) References Cited

U.S. PATENT DOCUMENTS

| | | | |
|---|---|---|---|
| 394,680 | A | 10/1888 | Dawes |
| 393,126 | A | 11/1888 | Smart |
| 506,388 | A | 10/1893 | Clark |
| 612,489 | A | 10/1898 | Dean |
| 684,264 | A | 10/1901 | Kemmerer |
| 866,473 | A | 9/1907 | Keefe et al. |
| 1,127,527 | A | 2/1915 | Schoen |
| 1,137,906 | A | 5/1915 | Rosenberg |
| 1,264,015 | A | 4/1918 | Cochrane |
| 1,501,524 | A | 7/1924 | Cousins |
| 1,631,488 | A | 6/1927 | Jones |
| 1,662,568 | A | 3/1928 | Foell |
| 1,704,626 | A | 3/1929 | Nero |
| 1,704,990 | A | 3/1929 | Peirce |
| 1,878,084 | A | 9/1932 | Winkler |
| 2,000,241 | A | 5/1935 | Mangin |
| 2,331,498 | A | 10/1943 | Otto |
| 2,518,936 | A | 8/1950 | Roberts |
| 2,541,828 | A | 2/1951 | Peck |
| 2,554,258 | A | 5/1951 | Lundquist |
| 2,602,881 | A | 7/1952 | Pryne |
| 2,639,368 | A | 5/1953 | Pryne |
| 2,647,202 | A | 7/1953 | Elmer |
| 2,676,849 | A | 4/1954 | Houck et al. |
| 2,691,541 | A | 10/1954 | Benedek |
| 2,716,185 | A | 8/1955 | Burliuk et al. |
| 2,719,374 | A | 10/1955 | Paione |
| 2,736,528 | A | 2/1956 | Brock |
| 2,739,226 | A | 3/1956 | Rex |
| 2,747,695 | A | 4/1956 | Schockett |

(Continued)

OTHER PUBLICATIONS

Lightolier, Installation Procedure for Convertible IC/Non IC Frame-In-Kits 1004IC, 1104SIC; Instruction Sheet No. IS:1104IC; pp. 1 and 2; Genlyte Group LLC; USA.

(Continued)

*Primary Examiner*—Gwendolyn Baxter

(57) ABSTRACT

The present invention is an adjustable hanger bar assembly for a light fixture. The assembly maintains structural integrity between first and second bars to support a recessed light fixture while being extended to distances where typical mounting assemblies fail. The hanger bar assembly comprises first and second bars which slidably engage one another. One of the first and second bars comprises a foldable foot which may be extended to increase the length of the hanger bar assembly.

18 Claims, 13 Drawing Sheets

U.S. PATENT DOCUMENTS

| | | | |
|---|---|---|---|
| 2,753,445 | A | 7/1956 | Thomas et al. |
| 2,757,818 | A | 8/1956 | Chamberlain |
| 2,762,598 | A | 9/1956 | Runge |
| 2,787,702 | A | 4/1957 | Oster et al. |
| 2,802,933 | A | 8/1957 | Broadwin |
| 2,842,281 | A | 7/1958 | Chisholm |
| 2,844,245 | A | 7/1958 | Gruber et al. |
| 2,863,990 | A | 12/1958 | Wince |
| 2,922,030 | A | 1/1960 | Bobrick |
| 2,937,841 | A | 5/1960 | Bodian |
| 2,965,348 | A | 12/1960 | Gerstel et al. |
| 3,003,735 | A | 10/1961 | Havener |
| 3,037,682 | A | 6/1962 | Daubert |
| 3,057,993 | A | 10/1962 | Gellert |
| 3,061,258 | A | 10/1962 | Grenier |
| 3,082,023 | A | 3/1963 | Rudolph et al. |
| 3,100,642 | A | 8/1963 | Goldstein |
| 3,118,621 | A | 1/1964 | Bailey |
| 3,130,949 | A | 4/1964 | Erhardt et al. |
| 3,158,329 | A | 11/1964 | Wince |
| 3,168,252 | A | 2/1965 | Cagernoch |
| 3,182,187 | A | 5/1965 | Gellert |
| 3,281,522 | A | 10/1966 | Anisfield |
| 3,313,931 | A | 4/1967 | Klugman |
| 3,316,399 | A | 4/1967 | Totten |
| 3,374,979 | A | 3/1968 | Coldren et al. |
| 3,381,123 | A | 4/1968 | Docimo |
| 3,420,995 | A | 1/1969 | Dunckel |
| 3,422,261 | A | 1/1969 | McGinty et al. |
| 3,495,024 | A | 2/1970 | Bowman |
| 3,512,743 | A | 5/1970 | Lipscomb |
| 3,518,420 | A | 6/1970 | Kripp |
| 3,589,660 | A | 6/1971 | Dunckel |
| 3,590,241 | A | 6/1971 | Docimo et al. |
| 3,597,889 | A | 8/1971 | Nigro |
| 3,601,862 | A | 8/1971 | Hargadon |
| 3,609,346 | A | 9/1971 | Lund et al. |
| 3,683,173 | A | 8/1972 | Guth, Jr. |
| 3,700,885 | A | 10/1972 | Bobrick |
| 3,743,228 | A | 7/1973 | Drab |
| 3,749,873 | A | 7/1973 | Harper et al. |
| 3,755,667 | A | 8/1973 | Price |
| 3,778,609 | A | 12/1973 | Liberman |
| 3,780,973 | A | 12/1973 | Dalton, Jr. |
| 3,783,176 | A | 1/1974 | Lund et al. |
| 3,801,815 | A | 4/1974 | Docimo |
| 3,833,113 | A | 9/1974 | Osier |
| 3,872,296 | A | 3/1975 | Cohen et al. |
| 4,000,406 | A | 12/1976 | Bhavsar |
| 4,041,657 | A | 8/1977 | Schuplin |
| 4,096,964 | A | 6/1978 | Glick |
| 4,118,760 | A | 10/1978 | Cohon |
| 4,129,948 | A | 12/1978 | Hatter et al. |
| 4,161,019 | A | 7/1979 | Mulvey |
| 4,191,352 | A | 3/1980 | Schuplin |
| 4,209,103 | A | 6/1980 | Glovier |
| 4,230,297 | A | 10/1980 | Comer et al. |
| 4,232,361 | A | 11/1980 | Kelsall |
| 4,250,540 | A | 2/1981 | Kristofek |
| 4,274,615 | A | 6/1981 | Chan et al. |
| 4,277,641 | A | 7/1981 | Bauer et al. |
| 4,293,895 | A | 10/1981 | Kristofek |
| 4,307,672 | A | 12/1981 | Shikimi |
| 4,313,154 | A | 1/1982 | Capostagno et al. |
| 4,318,161 | A | 3/1982 | Shanks |
| 4,318,162 | A | 3/1982 | Sip |
| 4,327,403 | A | 4/1982 | Capostagno et al. |
| 4,335,511 | A | 6/1982 | Bowling |
| 4,336,575 | A | 6/1982 | Gilman |
| 4,345,381 | A | 8/1982 | Brislin |
| 4,382,274 | A | 5/1983 | De Backer et al. |
| 4,388,677 | A | 6/1983 | Druffel |
| 4,388,890 | A | 6/1983 | Wester et al. |
| 4,400,766 | A | 8/1983 | Munson |
| 4,408,262 | A | 10/1983 | Kusmer |
| 4,414,617 | A | 11/1983 | Galindo |
| 4,419,717 | A | 12/1983 | Price et al. |
| 4,424,554 | A | 1/1984 | Woloski et al. |
| 4,431,151 | A | 2/1984 | Schonasky |
| 4,449,687 | A | 5/1984 | Karaktin |
| 4,450,512 | A | 5/1984 | Kristofek |
| 4,459,429 | A | 7/1984 | Docimo |
| 4,459,648 | A | 7/1984 | Ullman |
| 4,471,416 | A | 9/1984 | Druffel |
| 4,473,873 | A | 9/1984 | Quiogue |
| 4,475,147 | A | 10/1984 | Kristofek |
| 4,482,940 | A | 11/1984 | Brandherm |
| 4,497,014 | A | 1/1985 | Woloski et al. |
| 4,503,489 | A | 3/1985 | Duerr et al. |
| 4,510,559 | A | 4/1985 | Kristofek |
| 4,522,541 | A | 6/1985 | Bidwell |
| 4,605,816 | A | 8/1986 | Jorgensen et al. |
| 4,623,956 | A | 11/1986 | Conti |
| 4,646,212 | A | 2/1987 | Florence |
| 4,704,664 | A | 11/1987 | McNair |
| 4,705,255 | A | 11/1987 | Reed, Jr. |
| 4,723,747 | A | 2/1988 | Karp et al. |
| 4,729,074 | A | 3/1988 | Steadman |
| 4,729,080 | A | 3/1988 | Fremont et al. |
| 4,733,339 | A | 3/1988 | Kelsall |
| 4,745,533 | A | 5/1988 | Smerz |
| 4,751,624 | A | 6/1988 | Russo et al. |
| 4,751,627 | A | 6/1988 | Usher |
| 4,754,377 | A | 6/1988 | Wenman |
| 4,764,851 | A | 8/1988 | Hartmann |
| 4,792,191 | A | 12/1988 | Farmer |
| 4,803,603 | A | 2/1989 | Carson |
| 4,829,410 | A | 5/1989 | Patel |
| 4,887,196 | A | 12/1989 | Brown et al. |
| 4,894,759 | A | 1/1990 | Siems |
| 4,910,651 | A | 3/1990 | Montanez |
| 4,972,339 | A | 11/1990 | Gabrius |
| 4,989,334 | A | 2/1991 | DuBose, Jr. |
| 5,014,853 | A | 5/1991 | Crockett |
| 5,031,084 | A | 7/1991 | Russo et al. |
| 5,045,985 | A | 9/1991 | Russo et al. |
| 5,057,979 | A | 10/1991 | Carson et al. |
| 5,068,772 | A | 11/1991 | Shapiro et al. |
| 5,075,831 | A | 12/1991 | Stinger et al. |
| 5,077,650 | A | 12/1991 | Cestari |
| 5,094,359 | A | 3/1992 | DeMars et al. |
| 5,103,762 | A | 4/1992 | Long et al. |
| 5,110,038 | A | 5/1992 | Pantisano et al. |
| 5,122,944 | A | 6/1992 | Webb |
| 5,124,901 | A | 6/1992 | Sojka et al. |
| 5,130,914 | A | 7/1992 | Bengochea |
| 5,186,319 | A | 2/1993 | Ting |
| 5,222,800 | A | 6/1993 | Chan et al. |
| 5,236,157 | A | 8/1993 | Reggiani |
| 5,291,381 | A | 3/1994 | Price |
| 5,314,148 | A | 5/1994 | Jones |
| 5,317,493 | A | 5/1994 | Muller et al. |
| 5,373,431 | A | 12/1994 | Hayman et al. |
| 5,374,812 | A | 12/1994 | Chan et al. |
| 5,377,088 | A | 12/1994 | Lecluze |
| 5,386,959 | A | 2/1995 | Laughlin et al. |
| 5,410,462 | A | 4/1995 | Wolfe |
| 5,420,775 | A | 5/1995 | Kusmer |
| 5,452,193 | A | 9/1995 | Hinnefeld et al. |
| 5,452,816 | A | 9/1995 | Chan et al. |
| 5,457,617 | A | 10/1995 | Chan et al. |
| 5,465,199 | A | 11/1995 | Bray et al. |
| 5,505,419 | A | 4/1996 | Gabrius |
| 5,538,214 | A | 7/1996 | Sinila |

5,556,188 A 9/1996 Poppenheimer
5,562,343 A 10/1996 Chan et al.
5,564,815 A 10/1996 Littman et al.
5,567,041 A 10/1996 Slocum
5,588,737 A 12/1996 Kusmer
5,597,234 A 1/1997 Winkelhake
5,609,414 A 3/1997 Caluori
5,630,663 A 5/1997 Ling et al.
5,668,619 A 9/1997 Bolle
5,669,324 A 9/1997 Muir, III
5,672,004 A 9/1997 Schmidt, Jr.
5,678,794 A 10/1997 Kump
5,690,423 A 11/1997 Hentz et al.
5,707,143 A 1/1998 Hentz
5,725,302 A 3/1998 Sirkin
5,738,436 A 4/1998 Cummings et al.
5,746,507 A 5/1998 Lee
5,758,959 A 6/1998 Sieczkowski
5,800,050 A 9/1998 Leadford
5,803,585 A 9/1998 Littman et al.
5,823,664 A 10/1998 Demshki, Jr. et al.
5,826,970 A 10/1998 Keller et al.
5,836,678 A 11/1998 Wright et al.
5,857,766 A 1/1999 Sieczkowski
5,938,157 A * 8/1999 Reiker ..... 248/200.1
5,941,625 A 8/1999 Morand
5,951,151 A 9/1999 Doubeck et al.
5,957,572 A 9/1999 Wedekind et al.
5,957,573 A 9/1999 Wedekind et al.
5,957,574 A 9/1999 Hentz et al.
6,000,818 A 12/1999 Caluori
6,004,011 A 12/1999 Sieczkowski
6,062,704 A 5/2000 Holder
6,076,788 A 6/2000 Akiyama
6,079,852 A 6/2000 Kamaya et al.
6,095,669 A 8/2000 Cho
6,095,671 A 8/2000 Hutain
6,098,825 A 8/2000 Kohnen
6,105,918 A 8/2000 Gromotka
6,113,245 A 9/2000 Reinert, Sr.
6,132,245 A 10/2000 Wertz et al.
6,142,439 A 11/2000 Aramaki
6,145,798 A 11/2000 Janisse et al.
6,176,599 B1 1/2001 Farzen
6,220,728 B1 4/2001 Andrus et al.
6,234,644 B1 5/2001 Kotovsky et al.
6,270,238 B1 8/2001 Mendelsohn et al.
6,272,794 B1 8/2001 Rippel et al.
6,343,873 B1 2/2002 Eberhard et al.
6,364,510 B1 4/2002 Bernhart et al.
6,369,326 B1 4/2002 Rippel et al.
6,375,338 B1 4/2002 Cummings et al.
6,402,112 B1 6/2002 Thomas et al.
6,421,904 B1 7/2002 Wedekind et al.
6,431,723 B1 8/2002 Schubert et al.
6,461,016 B1 10/2002 Jamison et al.
6,484,979 B1 * 11/2002 Medlin, Jr. ..... 248/205.1
6,505,960 B2 1/2003 Schubert et al.
6,554,457 B1 4/2003 Platt
6,632,006 B1 10/2003 Rippel et al.
7,118,254 B2 10/2006 Czech
7,234,674 B2 6/2007 Rippel et al.
2003/0115767 A1 6/2003 Wedekind et al.

OTHER PUBLICATIONS

Lithonia Lightning; Features & Specifications; p. RINC-200; Lithonia Lightining; USA.

Lightolier; Lytening Convertible IC/Non-IC Frame-in Kit Improved Mounting Assembly; Brochure LOL6350; 2005; Genlyte Group LLC; USA.

Juno Lighting Group; Conixtm T4 Spot, Flood and Narrow Flood - TM116, TM117 and TM118; www.junolightinggroup.com; 2005; Juno Lighting Inc; USA.

Juno Lighting Group; Modular Hid Ballasts and Modular Hid Monopoints - TM539, TM570 and TMM5493, TMM5470 and TMM54100; www.junolightinggroup.com; 2005; Juno Lighting Inc; USA.

* cited by examiner

ADJUSTABLE HANGER BAR ASSEMBLY WITH BENDABLE PORTION

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to a recessed light mounting bar assembly, and more specifically to an adjustable mounting bar for mounting a light fixture within a suspended ceiling grid or joist structure.

2. Description of the Related Art

Recessed downlight fixtures have become increasingly popular for residential and commercial use. One reason for the increased popularity is that the recessed downlight fixtures meet a wide range of interior lighting requirements while also being aesthetically pleasing. Recessed lighting fixtures or downlights provide lighting for an area and are aesthetically pleasing due in part to the unobtrusive nature of the fixtures themselves which are typically recessed within the ceiling. Further, recessed downlight fixtures may be installed in new constructions as well as existing ceilings and therefore are valued by installers. Typically, ceiling-mounted recessed downlight fixtures comprise a frame-in kit with means for securing the frame to structural supports of the ceiling. For installation, the frame of the light fixture may include holes or brackets through which fasteners are used to position and attach the fixture to the supports.

A support system is often employed to suspend a recessed lighting fixture assembly between adjacent supports. Conventional downlights may be installed between ceiling joists or from suspended ceiling structures or grids, which may vary in spacing from one commercial or residential structure to another. Although the spacing of the ceiling structures may vary from one installation to another, the recessed fixtures must be rapidly adaptable for installation, in various locations, with minimal preparation and fastener requirements.

It is common to suspend a pair of spaced hanger bars between adjacent supports or joists. Prior downlight assemblies are typically mounted with hanger bar structures which are nailed to rafters, floor joists or connected to suspended ceiling grid structures. Prior art assemblies may utilize hanger bars which are adjustable in length in order to accommodate varying distances between joists and supporting structures of this nature. The hanger bars are typically positioned along opposite sides of a mounting pan. Some hanger bars having a two-piece construction are utilized to render the bars adjustable. The adjustable length allows the hanger bars to be mounted between support joists of various spacings. Two problems which are generally incurred when utilizing two-piece hanger bar constructions are a lack of stability and failure to provide support for the recessed fixture when the hanger bars are extended to a maximum length. For example, in some regions of the country building code requires the distance between ceiling joists to be 16 inches on-center. However, when utilized within a suspended ceiling support grid, the on-center distance between grid members may be up to 24". Thus, the hanger bar assembly must be slidably adjusted to a maximum distance in order to extend between the suspended ceiling support grid members. However, extension of prior art hanger bar assemblies results in lack of stability and structural integrity because of decreased engagement between slidable bars when they are fully extended.

Given the foregoing, it will be appreciated that achieve benefits derived from overcoming the shortcomings and detriments described previously.

SUMMARY OF THE INVENTION

The present invention solves these problems by providing hanger bar assembly which may be contracted and bent to a first minimized position or extended and bent to a second fully extended position.

According to a first embodiment, an adjustable mounting bar assembly for a luminaire fixture comprises a first bar adapted to be slidably received within a second bar portion, an arm bendably positioned at an end of one of the first bar or the second bar, a relief area disposed between the first arm and the one of the first bar or the second bar, the first bar and the second bar telescoping between a first minimized length and a second extended length. The arm is bendable to an extended position to provide increased length to said adjustable mounting bar assembly. The arm is bendable to extend the length of the adjustable mounting bar assembly and maintain engagement between the first bar and the second bar. The arm bendable from a first position substantially perpendicular to the one of the first bar or the second bar to a second position substantially parallel to the one of the first bar or the second bar. The arm has a notch for receiving a suspended ceiling grid. The adjustable mounting bars for a luminaire fixture further comprises a pivoting arm at the other of the first bar or the second bar. The second arm is pivotally connected to the other of the first bar or the second bar.

According to a second embodiment, a telescoping hanger bar assembly for a luminaire fixture assembly comprises a channel shaped to slidably receive a bar, a pre-stressed relief area disposed at an end of the bar and a first foot portion extending from the relief, the arm portion moveable at the relief from a folded position disposed at an angle to the one of the first bar and the second bar to substantially parallel to the one of the first bar member and the second bar member, the foot portion allowing increased engagement between the first bar member and the second bar member for increased integrity. The foot further comprises a notch for receiving a suspended ceiling support member. The telescoping hanger bar further comprises a pivoting foot extending from the channel. The pivoting foot extends substantially perpendicular from the channel. The second foot has a joist lip.

According to a third embodiment, a telescoping hanger bar assembly for a luminaire fixture assembly, comprises a first slidable bar having a relief at one end and a first foot connected to the relief, a second slidable bar receiving the first slidable bar, a second foot extending from an end of the second slidable bar and being pivotally connected to the second slidable bar opposite the first foot, the first foot being foldable along the pre-stressed relief area to increase a total length of said hanger bar assembly, one of the first slidable bar and the second slidable bar having at least one bead and the other of the first slidable bead and the second slidable bead having a positioning boss for locating the hanger bar assembly at preselected lengths. Wherein one of the first slidable bar and the second slidable bar has at least one boss of preselected length. Wherein the other of the first slidable bar and the second slidable bar have a bead which slides through the at least one boss. The telescoping hanger bar assembly for a luminaire fixture assembly further comprises a notch in the first foot for receiving a suspended ceiling structure. The telescoping hanger bar assembly for a luminaire fixture assembly further comprises a notch in the second foot for receiving a suspended ceiling structure.

According to a fourth embodiment, an adjustable hanger bar assembly for a luminaire fixture assembly, comprises a first bar defining a portion of the adjustable hanger bar assembly, a second bar shaped to slidably receive the bar defining a second portion of the adjustable hanger bar assembly, a pre-stressed relief area disposed at an end of the first bar, a first foot portion extending from the relief, the arm portion deformable at the relief from a folded position to an extended position substantially parallel to the first bar, the first bar having one of a bead or an elongated boss and the second bar having the other of the bead or the elongated boss. The first foot has a notch for receiving a suspended ceiling feature. The adjustable hanger bar assembly further comprises a pivoting foot having a notch for receiving a suspended ceiling feature. The present invention allows for extension or compression of a hanger bar assembly by both slidable adjustment and bending along a pre-stressed relief area.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
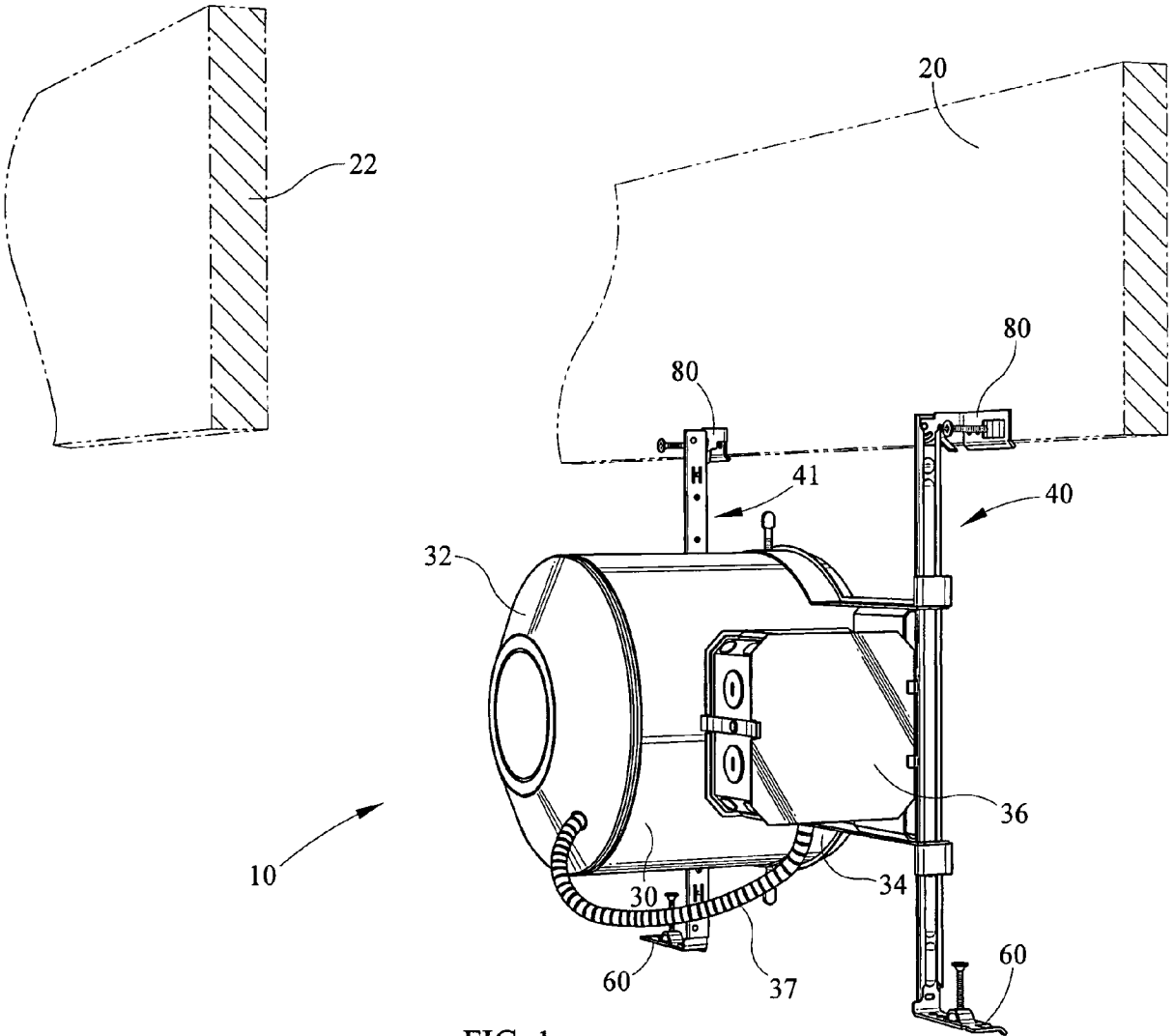
FIG. 1 is a perspective view of a frame-in kit including hanger bar assemblies depending from a ceiling joist for wiring connection.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention but other alternative mechanical configurations are possible.

Referring now in detail to the drawings, wherein like numerals indicate like elements throughout the several views, there are shown in FIGS. 1-13 various aspects of an adjustable mounting bar assembly for a recessed downlight. The adjustable hanger bar assembly allows the downlight to be mounted between ceiling joists or suspended from a suspended ceiling grid which may vary a substantial amount from the distance between ceiling joists while maintaining stability and structural integrity of the hanger bar assembly.

Referring initially to FIG. 1, a perspective view of the frame-in kit or rough-in kit 10 is shown. The frame-in kit 10 is suspended from a first ceiling joist 20 prior to suspending the frame-in kit 10 between the first joist 20 and a second, adjacent joist 22. The frame-in kit 10 comprises a fixture can or housing 30 which is substantially cylindrical in shape and is closed at one end of the cylinder. The inner area of the housing 30 retains a socket assembly (not shown) wherein a lamp or other light source is positioned and electrically connected. An end wall 32 substantially closes the can 30 at one end. The end wall 32 is depicted as substantially frusto-conical in shape which provides additional volume to the fixture can 30, however other shapes may be utilized. At an opposite end of the housing 30 is an open end from which light is emitted. Also, located adjacent the lower end of the housing 30 is a frame arm 34. The frame arm 34 connects a junction box 36 to the housing 30. One skilled in the art will also realize that the frame arm 34 may alternatively be a pan through which the housing 30 extends. The junction box 36 provides an enclosed space for electrical connection of the rough-in kit 10 to a power source. Within the junction box 36, electrical connections are made between the power supply and the wiring leading to the socket assembly (not shown) within the housing 30. The wires extending from the junction box 36 to the housing 30 are enclosed by a conduit 37, as generally required by electrical code. Alternatively, the conduit may not be required with use of approved wiring.

Extending along one side of the housing 30 adjacent the junction box 36 is a right hanger bar assembly 40. Opposite the right hanger bar assembly 40 is a left hanger bar assembly 41 which is substantially parallel to the hanger bar assembly 40. The hanger bar assemblies 40, 41 are each connected to the first joist 20 and are pivoted downwardly for wiring connection prior to connection of the hanger bar assemblies 40,41 to the second joists 22. The hanger bar assemblies 40, 41 are essentially mirror images of one another and thus, for purpose of clarity, only one hanger bar assembly 40 will be described, unless otherwise noted.

Figure 2:
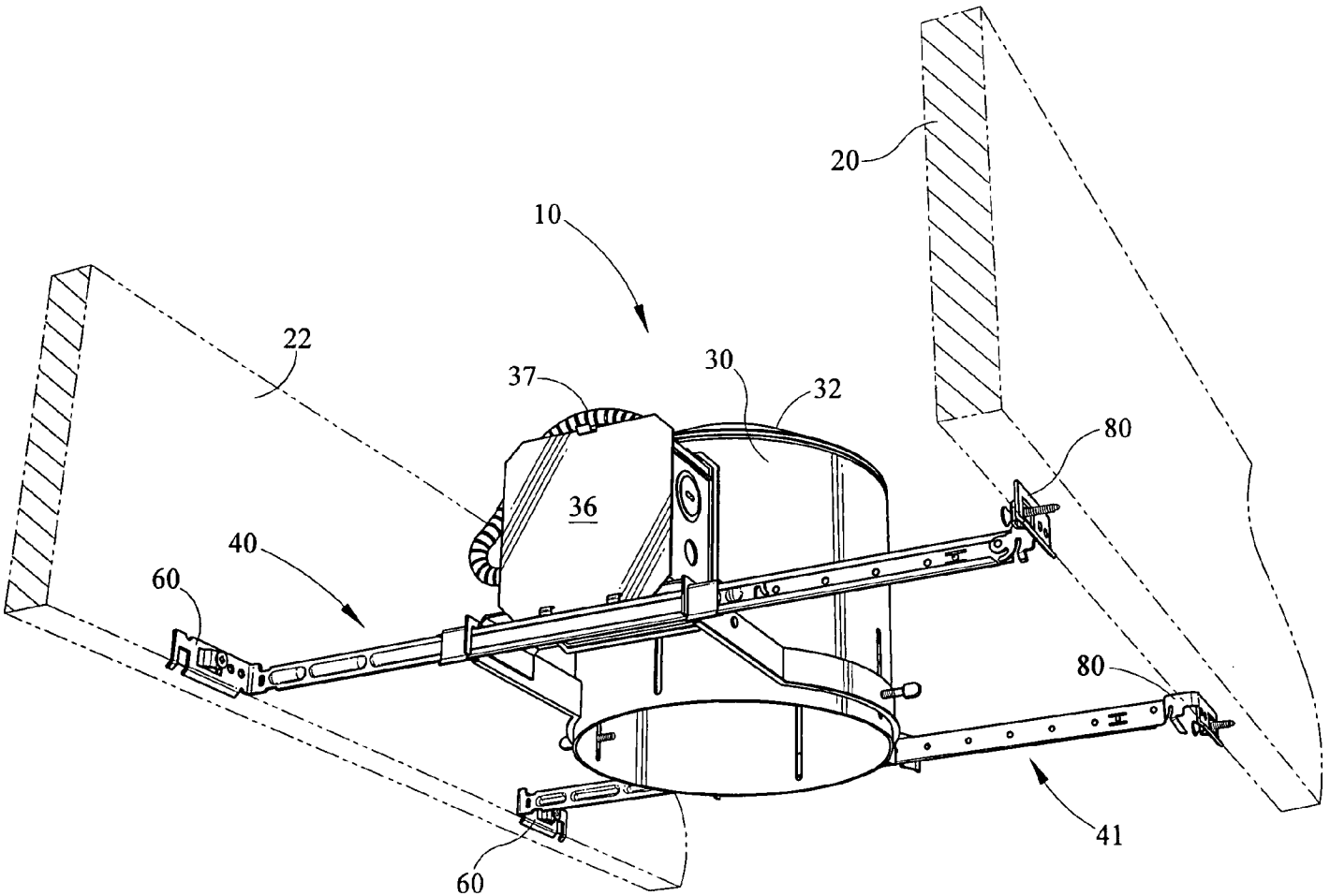
FIG. 2 is a perspective view of the frame-in kit of FIG. 1 rotated for connection during installation.

Referring now to FIG. 2, the frame-in kit 10 is shown pivoted from its hanging position in FIG. 1 to a suspended position ready for connection to the second ceiling joists 22. As previously indicated, the frame-in kit 10 is wired in the position shown in FIG. 1 with easy access to junction box 36. Subsequently, the frame-in kit 10 is rotated to its position shown in FIG. 2, to complete installation. At corresponding ends of each hanger bar assembly 40, 41 are pivoting feet or joist mounts 80, which are shown connected to the first joists 20. The opposite end of each hanger bar assembly 40, 41 is aligned with the second joists 22 for fastening connection thereto. The hanger bar assemblies 40, 41 each slidably extend or contract as well as bend to fit between ceiling members spaced apart within a pre-selected range. Thus, the frame-in kit 10 may be positioned between ceiling joists 20, 22 as shown or between suspended ceiling grid members (not shown) having a spaced apart distance within a range for use with the hanger bar assemblies 40, 41 herein. The frame-in kit 10 may also allow for vertical adjustment of the housing 30 and horizontal adjustment of the housing 30 along the hanger bar assemblies 40, 41 between the joists 20, 22.

Figure 3:
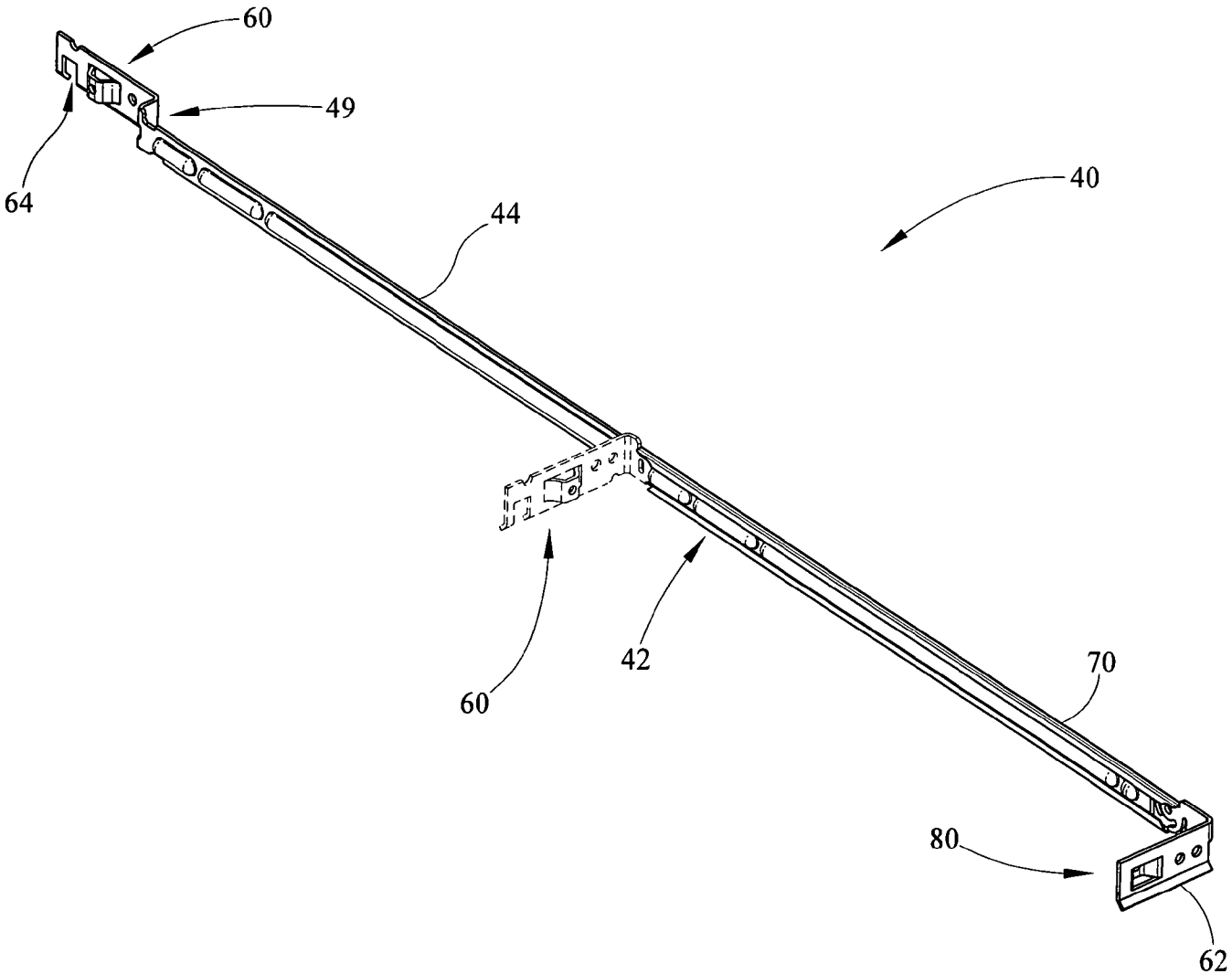
FIG. 3 is a perspective view of the hanger bar assembly of the present invention in both compressed and extended positions.

Referring now to FIG. 3, a perspective view of the hanger bar assembly 40 is depicted. It should be understood by one of ordinary skill in art that the hanger bar assembly 41 is a mirror image structure of the hanger bar assembly 40 for use on the opposite side of the frame-in kit 10 and therefore only one assembly will be discussed. The hanger bar assembly 40 comprises a first bar 42 and a second bar or channel 70 which is shaped to receive and allow slidable connection of the first bar 42. At one end of the bar 42 is a first arm or foot 60 extending substantially perpendicular from the bar 42. The foot 60 allows for connection of the hanger bar assembly 40 to a joist 22 (FIG. 2) or suspended ceiling (not shown) opposite the pivoting foot 80. At the opposite end of the channel 70, the pivoting joist mount 80 is pivotally connected which allows the pivotal movement depicted between FIGS. 1 and 2. The bar 42 comprises a first bar portion 44 which is shown in the extended position as well as the contracted position, in broken line. The first arm 60 is connected to the first bar portion 44 at a pre-stressed relief area 49. When the first arm 60 is folded from the position shown in broken line to the position shown in solid line and the first bar portion 44 is telescopically extended, the first arm portion 60 is parallel to the first bar portion 44. The pre-stressed relief area 49 causes the first arm 60 to fold in the same place for consistent installations. In the fully extended position, shown in solid line, the first arm or foot 60 provides additional length to the assembly 40 while maintaining engagement of the bar 42 and channel 70 to provide structural integrity.

Figure 4:
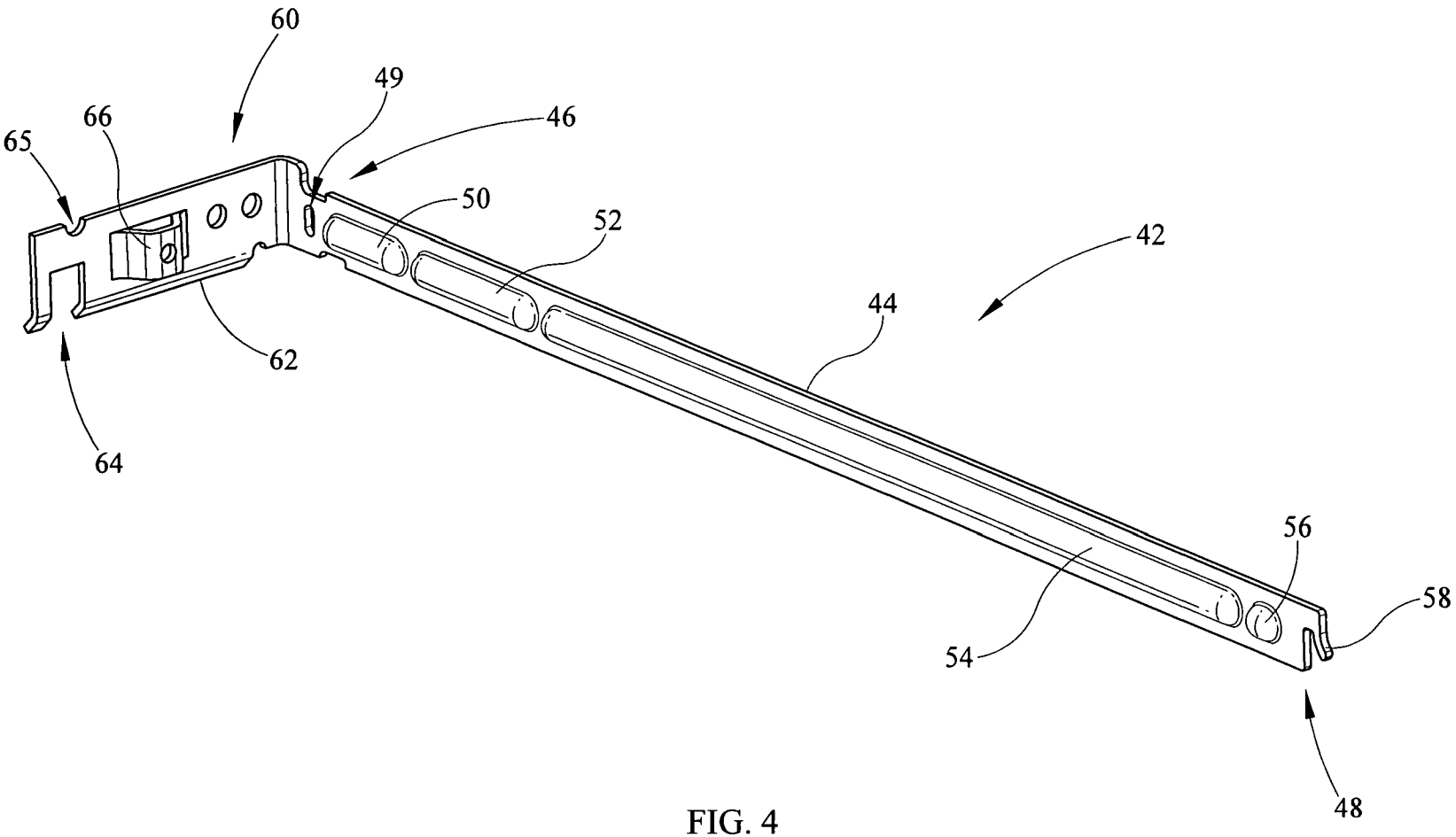
FIG. 4 is a perspective view of the bar portion of the hanger bar assembly of FIG. 3.

Referring now to FIG. 4, the bar 42 is shown in perspective view with the channel 70 (FIG. 3) removed. The bar 42 comprises a bar portion 44 which has a longitudinal axis and is substantially rectangular in shape. However, alternate shapes may be utilized which slide within the second bar 70. The bar portion 44 comprises a first end 46 and a second end 48. The bar 42 further comprises a first arm 60 connected to a first end of the bar portion 44 at a pre-stressed relief area 49. The bar portion 44 comprises a first boss 50, closest to the first arm 60. The bar portion 44 further comprises a second boss 52 which is elongated in comparison to the first boss 50. A third boss 54 is located adjacent the second boss 52 opposite the first boss 50 and is elongated in comparison to the first and second bosses 50, 52. Adjacent the third boss 54 near the second end of the bar portion 44 is a fourth boss 56 which is less elongated than the bosses 50, 52 and 54. The bosses 50, 52, 54, 56 allow movement or inhibit movement of the bar 42 relative to the channel 70. Also located at the second end of the bar portion 44 adjacent the fourth boss 56 is a pivot hook 58. The pivot hook 58 engages or disengages a corresponding hook 88 (FIG. 11) on the pivoting joist mount 80 and will be described further herein.

At the first end 46 of the bar portion 44, the first arm 60 extends at a substantially right angle to the bar portion 44. The first arm 60 is also substantially rectangular in shape. Along a lower edge of the first arm 60 is a joist lip 62. The joist lip 62 is disposed at an angle and engages a lower surface or edge of a joist as the bar 42 is pivoted upwardly at the pivoting joist mount 80. As the hanger bar assemblies 40,41 are pivoted from the position of FIG. 1 to FIG. 2, the joist lip 62 moves toward engagement with the second joist 22 (FIG. 2). The first arm 60 comprises a set screw mount 66 through which a fastener (FIG. 1) is disposed. The fastener may be fastened into the second joists 22 or other structural ceiling member to retain the bar 42 in position. The first arm 60 further comprises a notch 64 which is substantially U-shaped. When the first arm 60 is bent at the pre-stressed relief area 49, the first arm 60 moves into a parallel relationship with the bar portion 44 as shown in FIG. 3. The notch 64 is adapted to receive a suspended ceiling grid member for mounting in a suspended ceiling and may be alternative shapes which receive the suspended ceiling grid. Adjacent the notch 64 is a relief 65 for bending the outermost portion of the notch 64 against the suspended ceiling feature when the feature is disposed in the notch 64. This allows for tightening of the arm 60 to the suspended ceiling feature (not shown).

The bar 42 further comprises a pre-stressed relief area 49 adjacent the first end 46 of the bar portion 44 and is disposed between the bar portion 44 and the first arm 60. The relief area 49 is depicted in the illustrative embodiment as having an elongated circular shape but may be defined by alternative shapes. When the first arm 60 is bent, to elongate the bar 42, the first arm 60 folds relative to the bar portion 44 along the pre-stressed relief area 49. When folded to an extended position, the arm 60 is configured in a parallel relationship to the bar portion 44 as opposed to the configuration shown in FIGS. 4 and 5.

Figure 5:
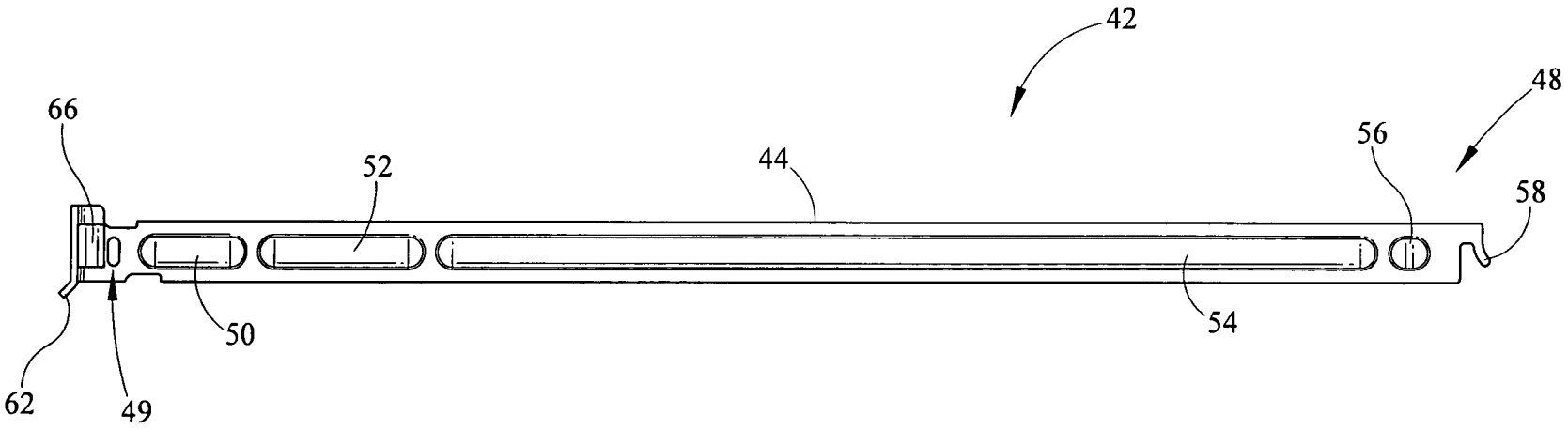
FIG. 5 is a side view of the bar portion of FIG. 4.
Figure 6:
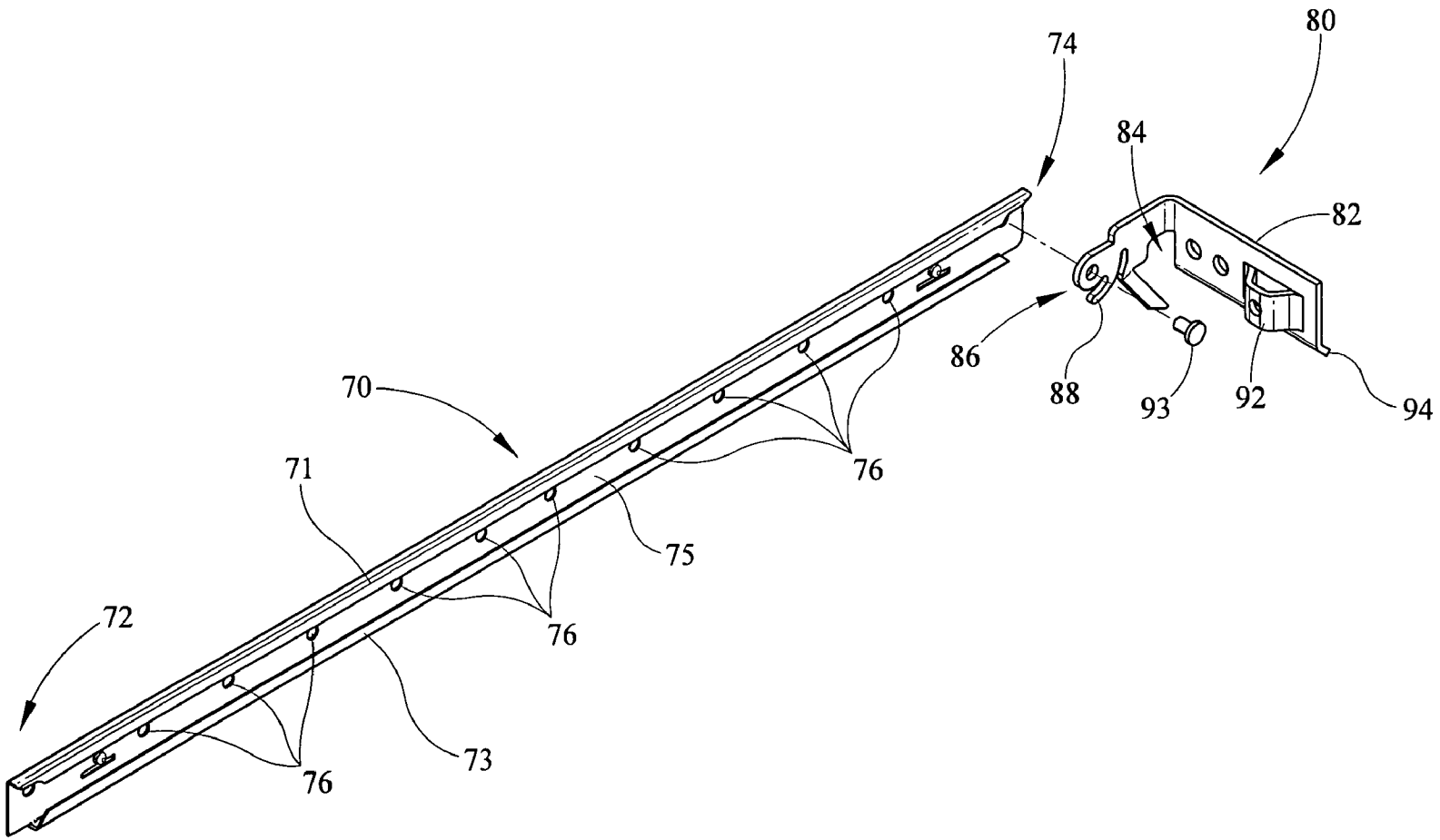
FIG. 6 is a perspective view of the channel and pivoting foot of FIG. 3.
Figure 7:
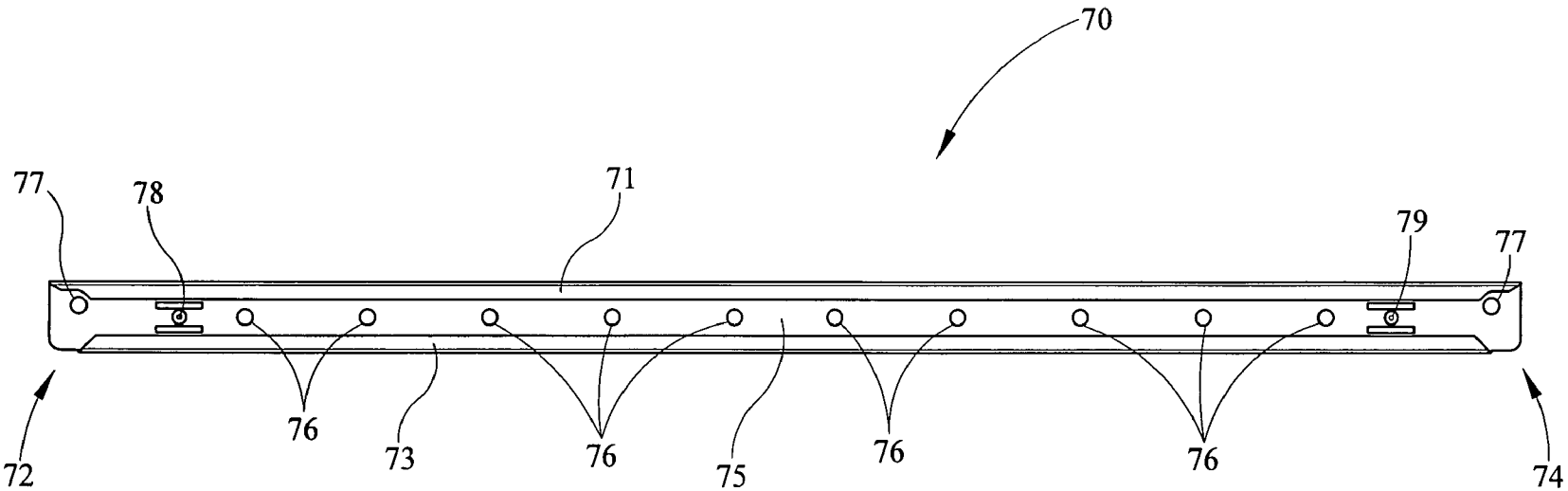
FIG. 7 is a side view of the channel.

Referring now to FIG. 5, a side view of the bar 42 is depicted. At the second end 48 of the bar portion 44 is the pivot hook or finger 58. The pivot hook 58 engages an opposed pivot finger or hook 88 (FIGS. 6, 11) on the pivot joist mount or foot 80 (FIG. 6). As depicted in FIG. 1, when the feet 80 are connected to the first joists 20 and the hanger bar assemblies 40, 41 are rotated 90° to depend from the feet 80, the pivot finger 58 engages the opposed finger 88 so that the bar 42 is inhibited from sliding within the channel 70. Alternatively, when the hanger bar assemblies 40, 70 are rotated into the position shown in FIG. 2, the pivot hook 58 and opposed pivot hook 88 are disengaged so that the bar 42 can slide relative to the channel 70.

As previously indicated, the bar 44 comprises four bosses 50, 52, 54, and 56. The four bosses 50, 52, 54 and 56 vary in length so that the bar 42 can slide to pre-selected positions relative to the channel 70. The pre-selected positions are determined by standard distances between joists or standard distances to suspend the frame-in kit 10 within suspended ceiling grids.

Referring now to FIGS. 6-9, the second bar or channel 70 is shown having a first end 72 and a second end 74. The channel 70 is substantially C-shaped having an upper curved surface 71 and a lower curved surface 73 and a substantially planer surface 75 extending between the upper and lower curved surfaces. Although the exemplary embodiment comprises a channel shape, alternative structural shapes may be utilized which receive the first bar 42 for slidable movement therein. In its operating orientation, the planer surface 75 is substantially vertical and comprises a plurality of apertures 76 at pre-selected positions between the first end 72 and the second end 74. The apertures 76 may be utilized to fasten the channel 70 in a specific position or tie the channel 70 to a suspended ceiling grid using a wire tie, twine, or other such structure. At the first end 72 of the channel 70 is a first bead 78, the bead or dimple 78 extends from the planer surface and is substantially circular in shape. However, other shapes may be utilized in place of the substantially circular shape in the illustrative embodiment depicted in FIG. 6. At the second end 74 of the channel 70 is a second bead 79. The second bead 79 is also substantially circular in shape but may alternatively comprise some other shape. The first bead and second bead 78, 79 each extend inwardly within the substantially C-shaped channel 70. It should also be noted that the channel 70 may be some other shape, other than C-shaped, which allows the bar 42 to slide therethrough. Also located at the first and second ends 72, 74 are feet apertures 77. Apertures 77 located at each end of the channel 70 for common use on left hand and right hand side hanger bar assemblies for connecting the pivoting joists mount 80. The shape and design of the channel 70 allows the channel 70 to be utilized for either the hanger bar assembly 40 or hanger bar assembly 41. In other words, the design is common.

Figure 8:
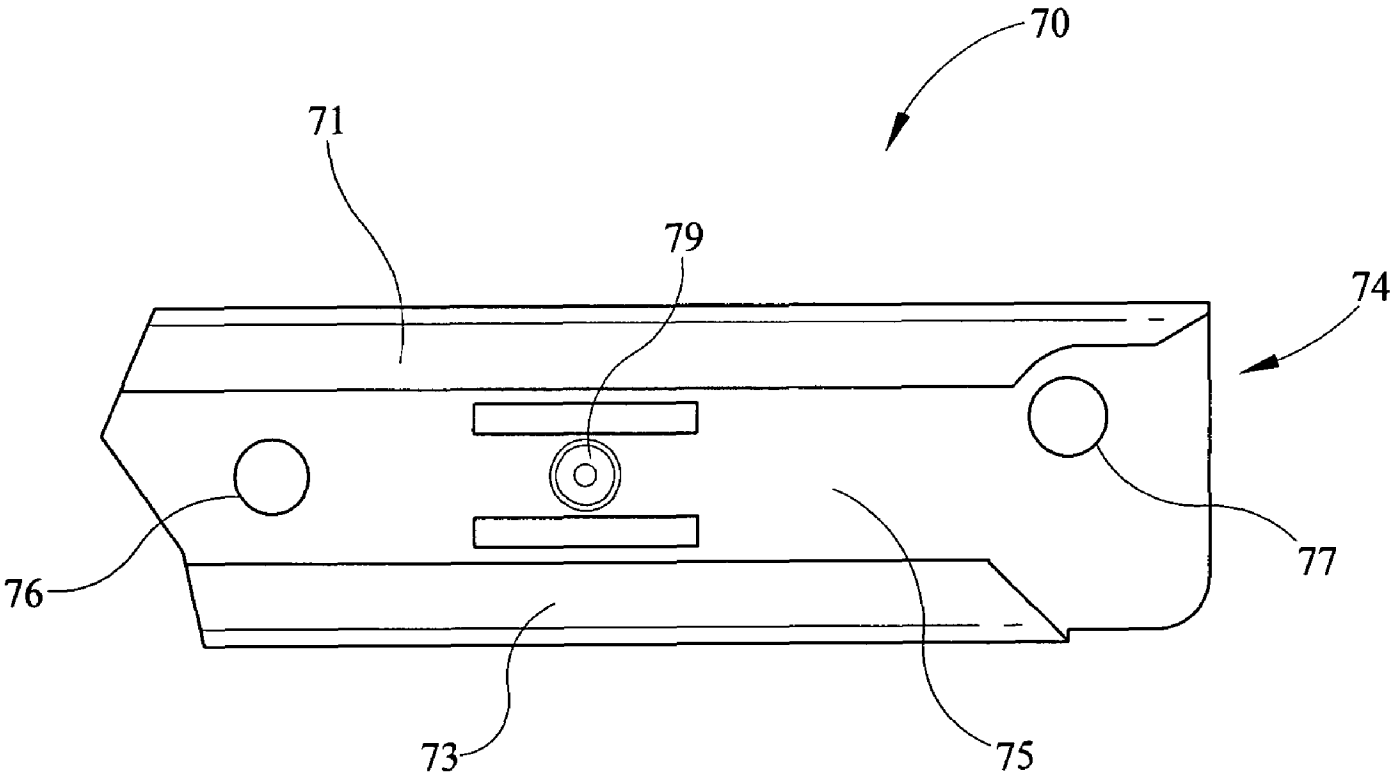
FIG. 8 is a close-up side view of one end of the channel of FIG. 7.
Figure 9:
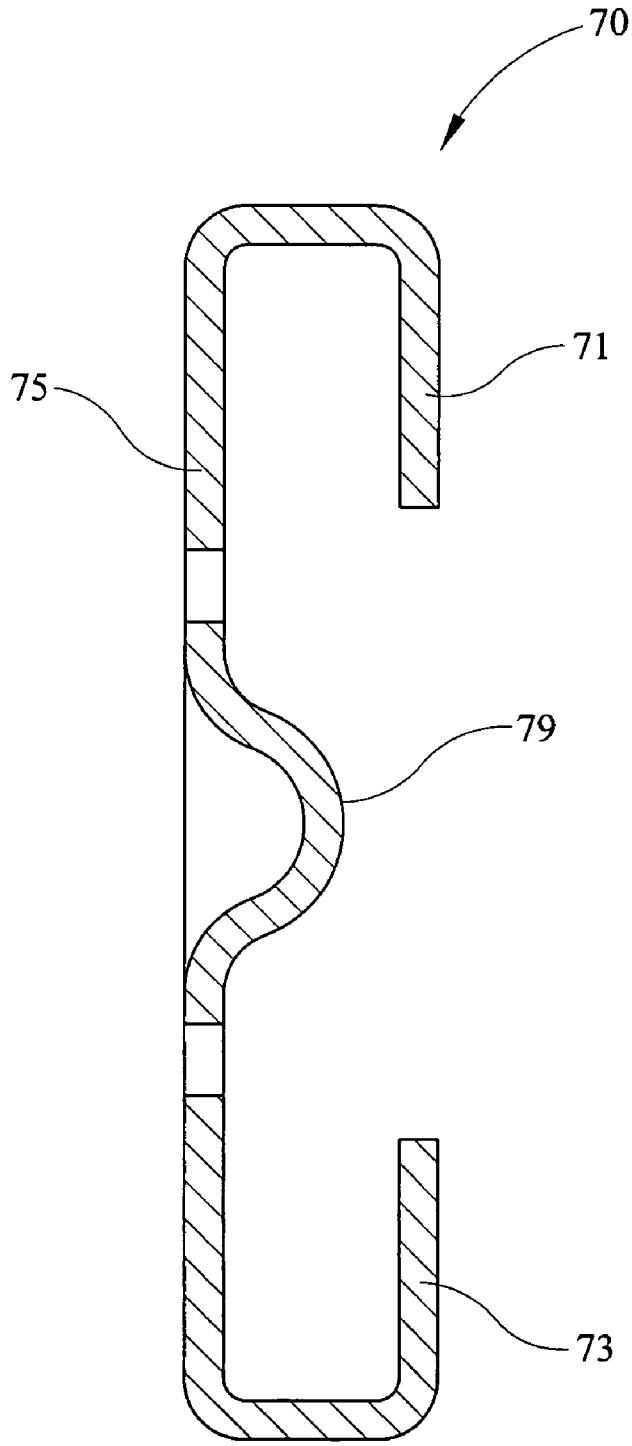
FIG. 9 is a side sectional view of the channel of FIG. 8.
Figure 10:
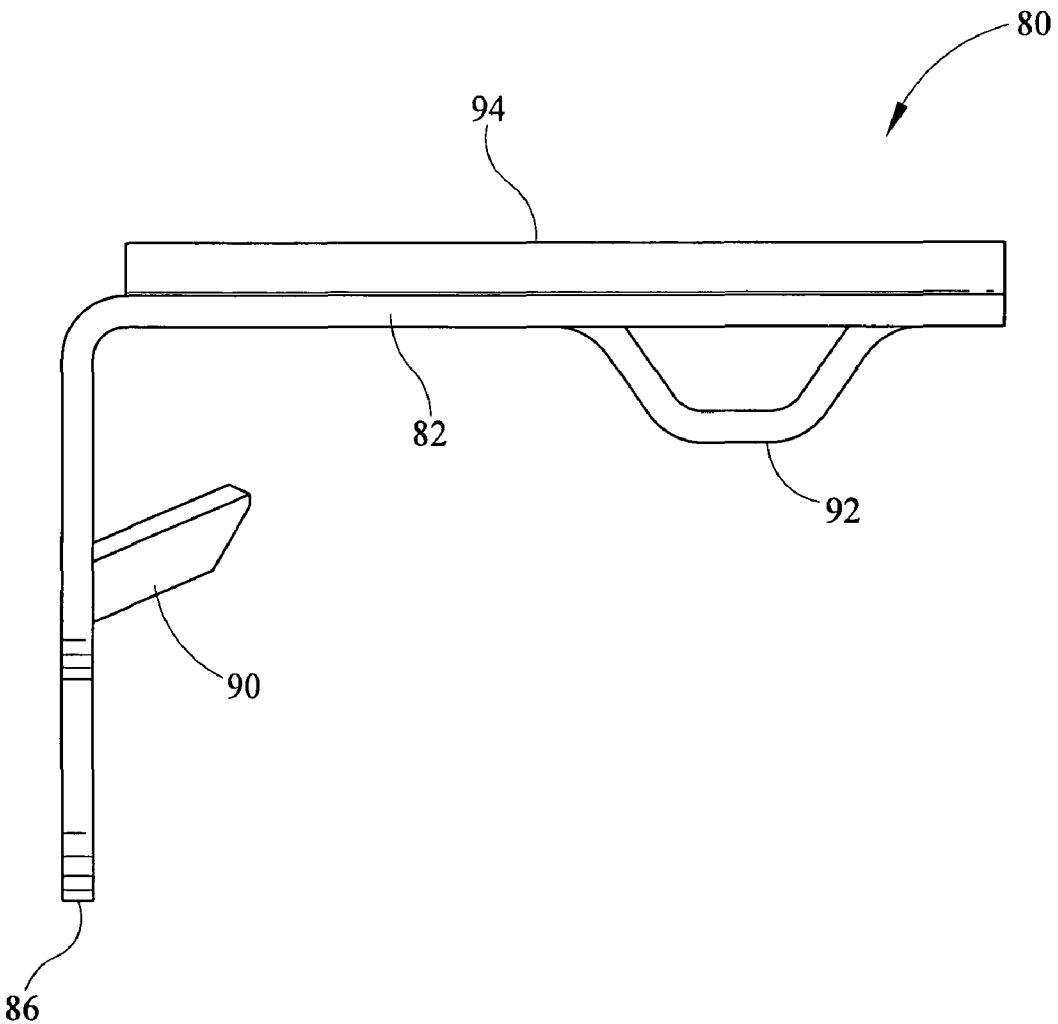
FIG. 10 is a top view of the pivoting joist mount of FIG. 6.
Figure 11:
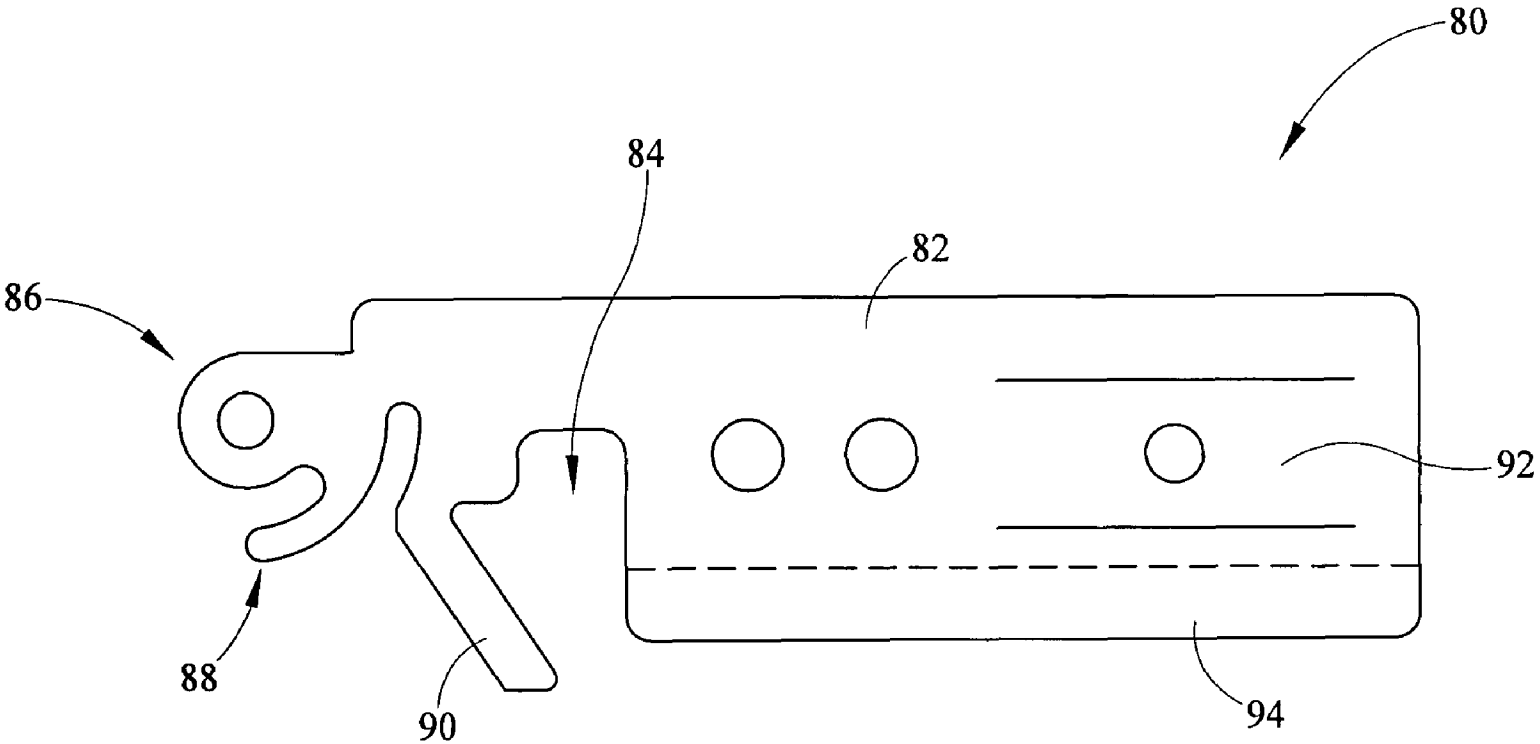
FIG. 11 is a side view of the pivoting joist mount of FIG. 6 before the mount is bent.
Figure 12:
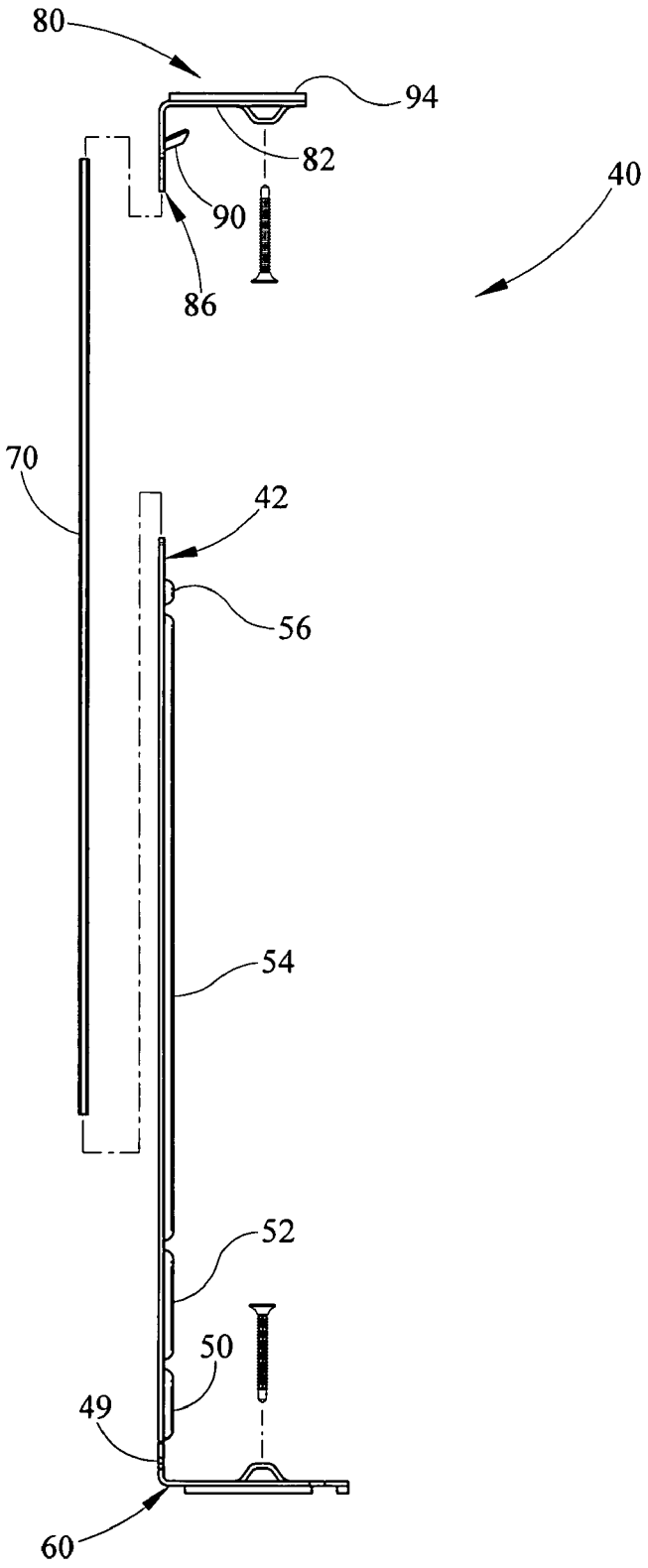
FIG. 12 is an exploded top view of the adjustable hanger bar assembly.

Referring to FIG. 8, a detailed view of the second end of channel 70 is depicted. The foot mounting aperture 77 is shown at the second end 74 for mounting a foot 80 (FIG. 1) to the channel 70. The foot 80 (FIG. 1) may be connected to the channel 70 by a fastener 93 (FIG. 6) such as a screw, a bolt and nut, or a rivet. The connection between the channel 70 and the aperture 77 should allow pivotal movement of the foot 80 (FIG. 1) relative to the channel 70 for movement between the positions shown in FIG. 1 and FIG. 2. The second bead 79 is also depicted in FIGS. 8-9 extending inwardly to the channel 70. As shown in FIG. 9, the bead 79 extends into the volume of the channel and provides interference with the bar 42 (FIG. 4) sliding therethrough. When the bar 40 is slideably disposed within the channel 70, the bar 42 will freely slide when the first and second beads 78, 79 are not engaging the bar 42 or when the first bead 78 is located in one of the bosses 52, 54. When the second bead 79 engages the fourth boss 56, the first boss is engaged by the first bead and the bar is inhibited from moving. Alternatively, as the first and second beads 78, 79 move between bosses 50, 52, 54, 56, the beads 78, 79 lack clearance to move freely and instead interfere with the bar 42. When disposed in these positions, the installer must forcibly slide the bar 42 through the channel 70. When the second bead 79 is disposed in the fourth boss 56, the assembly 40 is fully compressed. In addition to the opposed fingers or hooks 58, 88, such position inhibits the bar 42 from sliding through the channel 70 when the hanger assemblies 40, 41 are hanging in a position shown in FIG. 1. As the bar 42 is pulled from the channel 70 in opposed directions the first bead 78 engages the second boss 52. The second boss 52 may have a pre-selected length of a specific distance allowing mounting of the hanger bar assemblies 40, 41 between joists of a pre-selected on-center distance, for example, joists having an on-center distance of 16 inches. With continued opposed pulling of the bar and channel 42, 70, the first bead 78 passes from the second boss 52 into the third boss 54. The third boss 54 is depicted having the longest elongated length of the four bosses. When the first bead 78 is positioned within the third boss 54, the bar 42 and channel 70 may be telescopically extended to a length allowing the assembly to be fitted between joists of a preselected extended length, such as 24 inches on-center. Once the bar 42 and channel 70 are fully expanded so that the bead 78 engages the distal end of the third boss 54, the first arm 60 may be bent or unfolded along the pre-stressed relief area 49 for use in a suspended ceiling grid. When the first arm 60 is bent into the substantially parallel extended position, the distance from the pre-stressed area 49 to the far end of the first arm 60 adds to the total length of the bar 42. As such, the present invention limits the amount that the bar 42 must be pulled from the channel 70. Accordingly, by unfolding the first arm 60 and adding to the total length of the bar 42, the present invention adds to the stability and structural integrity of the connection between the bar 42 and channel 70. Thus, the slideable design in combination with the bendable arm 60 allows the extended distance of the hanger bar assemblies 40, 41 to be maximized without minimizing contact between the boss 42 and channel 70 and reducing the structural integrity of the hanger bar assemblies 40, 41. The present invention also minimizes the contracted distance of the hanger bar assemblies 40, 41 when the first arm 60 is folded to a position perpendicular to the bar portion 44.

As shown in FIGS. 6 and 10-12, the pivoting foot or joist mount 80 is depicted in various views. The pivoting joist mounts or feet 80 are pivotally connected to each channel 70 and allow connection of one side of the frame-in kit 10 (FIG. 1) to a first joist 20. The pivoting joist mounts 80 further allow pivotal movement of the frame-in kit 10 from a hanging position shown in FIG. 1 to a suspended position for connection shown in FIG. 2. The pivoting joist mount 80 comprises a second arm 82 which substantially opposes the first arm 60. The second arm 82 is substantially perpendicular to a pivoting member 86. The pivoting member 86 is connected by a fastener 93, such as a rivet, to the channel 70. Depending from the pivoting member is the opposed pivot finger or hook 88 which engages the pivot finger or hook 58 (FIG. 4) as previously described. A suspended ceiling grid notch 84 is defined between the second arm 82 and pivot member 86. The notch 84 provides a space to receive the suspended ceiling grid member. A foldable catch 90 is located adjacent the grid notch 84 and is formed to be folded against a suspended ceiling grid member disposed within the grid notch 84 to lock the pivoting joist mount 80 in position on the suspended ceiling grid member. Alternatively, the second arm 82 further comprises a set screw mount 92 which allows a fastener to extend through the second arm 82 and into a joists or other ceiling structure for connecting the pivoting joists mount to a ceiling member. Along the lower edge of the second arm 82 is a joist lip, similar to the joist lip of the first arm 60. The joist lip 94 engages a lower surface or edge of the first joist 20 to aid in positioning each end of the hanger bar assembly at the same relative height.

In operation, according to a first embodiment of connection, the feet 80 are abutted against a lower edge of the joist 20 as shown in FIG. 1. Once the feet 80 are fastened to the joist 20, the force of gravity causes the frame-in kit 10 to pivot at the connection of the feet 80 and the second bars so that the hanger bar assemblies 40, 41 are generally hanging downwardly. In this position, the engagement of the opposed pivot hooks inhibits the hanger bar assemblies 40, 41 from sliding downwardly. From this position, an installer uses the junction box 36 to connect the power source to the wiring extending into the housing 30. Once the wiring connections are made within the junction box 36 and the lighting socket and light source are disposed within the can 30, the frame-in kit 10 is pivoted at the feet 80 into a position shown in FIG. 2. From this position, the opposed feet 60 may be engaging the second joist 22. Specifically, the joist lip 62 (FIG. 3) on the opposed feet 60 engage the lower edge of the second joist 22 to provide a level configuration for the frame-in kit 10. Further, if need be, the hanger bar assemblies 40, 41 may be slidably extended so that the opposed feet 60 properly engage the second joist 22. However, such sliding is dictated by the distance between the first and second joists 20, 22 and is further dependent upon building codes within the specific regions of the country. Once the feet 60 are engaging the second joist 22, fasteners are utilized to connect the feet 60 to the joist 22 thus suspending the frame-in kit 10 between ceiling structures.

Figure 13:
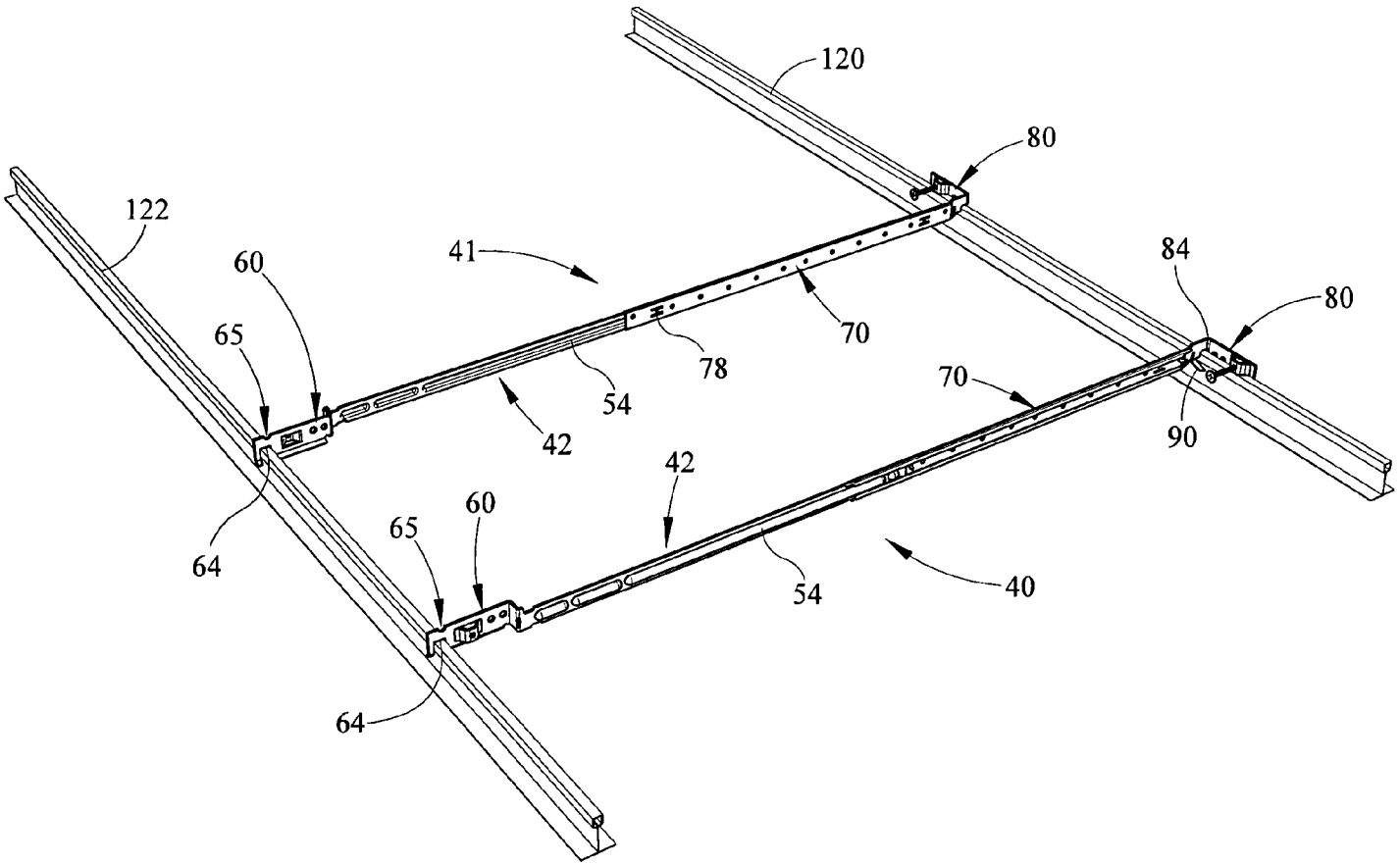
FIG. 13 is a perspective view of the adjustable hanger bar assembly of the present invention connected to a suspended ceiling structure.

Referring now to FIG. 13, according to a second embodiment of connection, opposed T-bars 120, 122 are shown which define, in part, portions of a suspended ceiling. The housing 30 and other portions of the frame-in kit 10 are removed for clarity to depict the adjustable hanger bar assemblies 40, 41. At one end, of the hanger bar assemblies, the feet 80 are connected to the T-grid 120 by receiving a feature of an upper portion of the grid within the notch 84. In order to secure the hanger bar assemblies 40, 41 to the T-grid 120, each foldable catch 90 is bent to engage the T-grid 120 and lock the adjustable hanger bar assemblies 40, 41 to the T-grid 120. Next, the bars 42 are slidably extended within the channels 70 until the appropriate length is obtained to span the distance between the first T-grid 120 and the second T-grid 122 of the suspended ceiling structure. According to one embodiment, the bead 78 of the channel 70 may engage the end of the third boss 54. Finally, the feet 60 are folded along the relief area 49 so that the feet 60 are substantially parallel to the bar 42 and channel 70. The notch 64 of each foot 60 receives a feature of the T-grid 122 thus spanning the distance between the suspended ceiling structures 120, 122. When the suspended ceiling feature is located in the notch 64, the relief 65 allows bending of the outermost portion of the arm 60 defining the notch 64 to tighten the arm 60 to the suspended ceiling structure 122. As one of ordinary skill in the art will recognize by this invention, the folding structure in combination with the slidable engagement of the hanger bar assemblies 40, 41 minimizes the amount of disengagement between the bars 42 and channels 70 by a distance equal to the extended length of the feet 60. This retains the stability in integrity of the hanger bar assemblies 40, 41 in order to support the remaining portions of the frame-in kit 10 (FIG. 1).

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An adjustable mounting bar assembly for a luminaire fixture, comprising:

a first bar portion adapted to be slidably received within a second bar portion;

an arm bendably positioned at an end of one of said first bar portion or said second bar portion, said arm being bendable to one of a first operative position or a second operative position;

a relief area defined by a geometric shape of removed material disposed between said first arm and said one of said first bar or said second bar, said relief area having a vertical axis and said arm being bendable about said vertical axis to either of said first operative position or said second operative position;

said first bar and said second bar telescoping between a first minimized length and a second extended length;

a notch disposed in said arm for receiving a grid member;

a fastener aperture disposed in said arm for connecting to a joist;

a joist alignment protuberance on said arm for engagement with said joist.

2. The adjustable mounting bars for a luminaire fixture of claim 1, said arm bendable to an extended position to provide increased length to said adjustable mounting bar assembly.

3. The adjustable mounting bar assembly for a luminaire fixture of claim 1, said arm bendable to extend the length of said adjustable mounting bar assembly and maintain engagement between said first bar and said second bar.

4. The adjustable mounting bars for a luminaire fixture of claim 1, said arm bendable from a first position substantially perpendicular to said one of said first bar or said second bar to a second position substantially parallel to said one of said first bar or said second bar.

5. The adjustable mounting bar assembly for a luminaire fixture of claim 1, said arm having a notch for receiving a suspended ceiling grid.

6. The adjustable mounting bars for a luminaire fixture of claim 1 further comprising a pivoting arm at the other of said first bar or said second bar.

7. The adjustable mounting bars for a luminaire fixture of claim 6 said pivoting arm being pivotally connected to the other of said first bar or said second bar at an end distal from said first bar.

8. A telescoping hanger bar assembly for a luminaire fixture assembly, comprising:

a channel shaped to slidably receive a bar, said channel and said bar oriented so that a web extends vertically;

a pre-stressed relief area disposed at an end of one of said channel and said bar and a first foot portion extending from said relief, said relief allowing pivoting of said first foot about a vertical axis from a first operative folded position to a second operative substantially parallel position, said pre-stressed relief area defining said vertical axis;

said foot portion moveable at said relief from said folded position disposed at an angle to said one of said bar and said channel to said substantially parallel position to said one of said bar and said channel;

said foot portion allowing increased engagement between said first bar member and said second bar member for increased integrity;

a pivoting foot extending from the other of said channel and said bar;

at least one of said first foot and said pivoting foot having a joist lip.

9. The telescoping hanger bar of claim 8, said foot further comprising a notch for receiving a suspended ceiling support member.

10. The telescoping hanger bar of claim 8, said pivoting foot extending substantially perpendicular from said channel.

11. A telescoping hanger bar assembly for a luminaire fixture assembly, comprising:

a first slidable bar having a relief at one end and a first foot connected to said relief;

a second slidable bar receiving said first slidable bar, said first slidable bar and said second slidable bar oriented so that said relief having a vertical axis allows bending of said first foot about said vertical axis, between a first operative position and a second operative position;

a second foot extending from an end of said second slidable bar and being pivotally connected to said second slidable bar opposite said first foot;

said first foot being foldable along said pre-stressed relief area to increase or decrease a total length of said hanger bar assembly;

one of said first slidable bar and said second slidable bar having at least one bead and the other of said first slidable bar and said second slidable bar having a positioning boss for locating said hanger bar assembly at preselected lengths at least one of said first foot and said second foot having an alignment lip for engaging;

said foldable foot portion providing increased length of said first and second bars without decreasing engagement between said first bar member and said second bar member and therefore providing increased integrity.

12. The telescoping hanger bar assembly for a luminaire fixture assembly of claim 11 wherein one of said first slidable bar and said second slidable bar has at least one boss of preselected length.

13. The telescoping hanger bar assembly for a luminaire fixture assembly of claim 11 wherein the other of said first slidable bar and said second slidable bar have a bead which slides through said at least one boss.

14. The telescoping hanger bar assembly for a luminaire fixture assembly of claim 11 further comprising a notch in said first foot for receiving a suspended ceiling structure.

15. The telescoping hanger bar assembly for a luminaire fixture assembly of claim 11 further comprising a notch in said second foot for receiving a suspended ceiling structure.

16. An adjustable hanger bar assembly for a luminaire fixture assembly, comprising:

a first bar defining a portion of said adjustable hanger bar assembly;

a second bar shaped to slidably receive said bar defining a second portion of said adjustable hanger bar assembly;

a pre-stressed relief area disposed at an end of said first bar, said pre-stressed relief area having a vertical axis when said hanger bar assembly is disposed in an operable orientation;

a first arm portion extending from said relief;

said arm portion deformable about said vertical axis at said relief from a first operative folded position to a second operative extended position substantially parallel to said first bar;

said extended position allowing increased hanger bar assembly length while maintaining engagement of said first and second bars to provide structural integrity;

said arm portion having an aligning feature for positioning said arm along an edge of a ceiling joist when said arm portion is in said folded position.

17. The adjustable hanger bar assembly of claim 16, said first arm having a notch for receiving a suspended ceiling feature.

18. An adjustable hanger bar assembly of claim 16 further comprising a pivoting foot having a notch for receiving a suspended ceiling feature.

* * * * *